United States Patent [19]

Kuwabara et al.

[11] Patent Number: 4,638,128

[45] Date of Patent: Jan. 20, 1987

[54] DELAY SWITCH

[75] Inventors: Hideo Kuwabara; Takao Ohta, both of Tsu, Japan

[73] Assignee: Matsushita Electric Works, Ltd., Osaka, Japan

[21] Appl. No.: 766,397

[22] Filed: Aug. 16, 1985

[30] Foreign Application Priority Data

Aug. 25, 1984 [JP] Japan ..... 59-177312

[51] Int. Cl.[4] ..... H01H 7/00

[52] U.S. Cl. ..... 200/33 R; 200/153 V; 200/153 HS

[58] Field of Search ..... 200/33 R, 33 A, 33 B, 200/33 C, 33 D, 34, 153 V, 153 HS

[56] References Cited

U.S. PATENT DOCUMENTS 2,157,664 5/1939 Hansen ..... 200/33 R 2,326,957 8/1943 Maquire ..... 200/33 R

FOREIGN PATENT DOCUMENTS 39590 11/1972 Japan .

*Primary Examiner*—A. D. Pellinen

*Assistant Examiner*—Morris Ginsburg

*Attorney, Agent, or Firm*—Burns, Doane, Swecker & Mathis

[57] ABSTRACT

A delay switch comprising a delay element provided in the center of a body to produce a delayed output, a delay cam unit provided on one side of the delay element to start its actuation always from an identical position in response to the delayed output, and switching contact members electrically connected to terminals on other opposing sides of the delay element through the delay cam unit, realizing thus concurrently a constant delay time and a compact assembly.

8 Claims, 5 Drawing Figures

DELAY SWITCH

TECHNICAL BACKGROUND OF THE INVENTION

This invention relates to delay switches and, more specifically, to a switch in which contacts are closed or opened following a predetermined delay time after ON or OFF actuation of the switch.

The delay switch of the kind referred to is useful when used as a switch for a ventilating fan in a toilet or the like to cause the fan to run for a predetermined time after a turning-off operation by a user of the switch upon his departure from the toilet.

DISCLOSURE OF PRIOR ART

In conventional delay switches of this kind, an oil dash pot has been used as a delay element, which is operatively associated with a magnetic device and switching contact members so that, when the switch is turned OFF, for example, the dash pot put into non-excited state causes its plunger to be separated from a magnetic head only after a predetermined time elapsed to have the contact members opened. When this switch is used for the toilet ventilating fan, therefore, the turning OFF operation by the user of switch handle, lever or the like allows an actual opening of the contact members to take place as delayed by a required operating time of the oil dash pot, during which the fan is kept being operated to sufficiently remove any offensive odor from the toilet.

When it is desired to obtain a relatively constant delay time in such oil dash pot, it is necessary to have the operation of the dash pot started from either one of its two stable states in which the plunger is positioned to be closest to and furthest from the magnetic head. If this switch is frequently operated, therefore, there has arisen such a problem that the plunger being moved from one of the two extreme positions to the other is caused to be reversed before it reaches the other position, and the predetermined delay operation is left incomplete. Further, the oil dash pot has been defective in that the delay time is influenced by variations in the ambient temperature and in the mounting state, i.e., whether the plunger is disposed to move vertically or horizontally. Also, the oil dash pot occupies a relatively large space in order to achieve a sufficient stroke of the plunger movement for obtaining a required delay time, making it impossible to minimize the size of the switch.

Further, a delay switch employing a delay element by means of a gear train has been suggested in Japanese Utility Model Publication No. 39590/1972, but this switch involves a problem in that the train is structurally complicated and is not contributive to a minimization of the switch size.

TECHNICAL FIELD OF THE INVENTION

A primary object of the present invention is, therefore, to provide a delay switch which provides a constant delay time which is not influenced by any variation in ambient temperature and mounting state thereby to be easily incorporated and, in particular, the size of the switch to be effectively minimized.

According to the present invention, this object can be realized by providing a delay switch comprising a body, a cover member integrally mounted onto the body and having a top opening, a delay element disposed substantially in the center of the body and providing a delayed output, and delay cam unit provided on one side of the delay element as operatively linked thereto for performing a delay operation in response to the delayed output, switching contact members including a movable contact linked to the delay cam unit to be actuated with a predetermined delay time, terminal plate members provided on other opposing sides of the delay element and electrically connected to the contact members and to connecting wires inserted through connecting holes of the body, and contact actuating means positioned above the delay element within the cover member and including a rockable actuating handle disposed in the opening of the cover member.

Other objects and advantages of the present invention shall become clear from the following description of the invention detailed with reference to a preferred embodiment shown in accompanying drawings.

Figure 1:
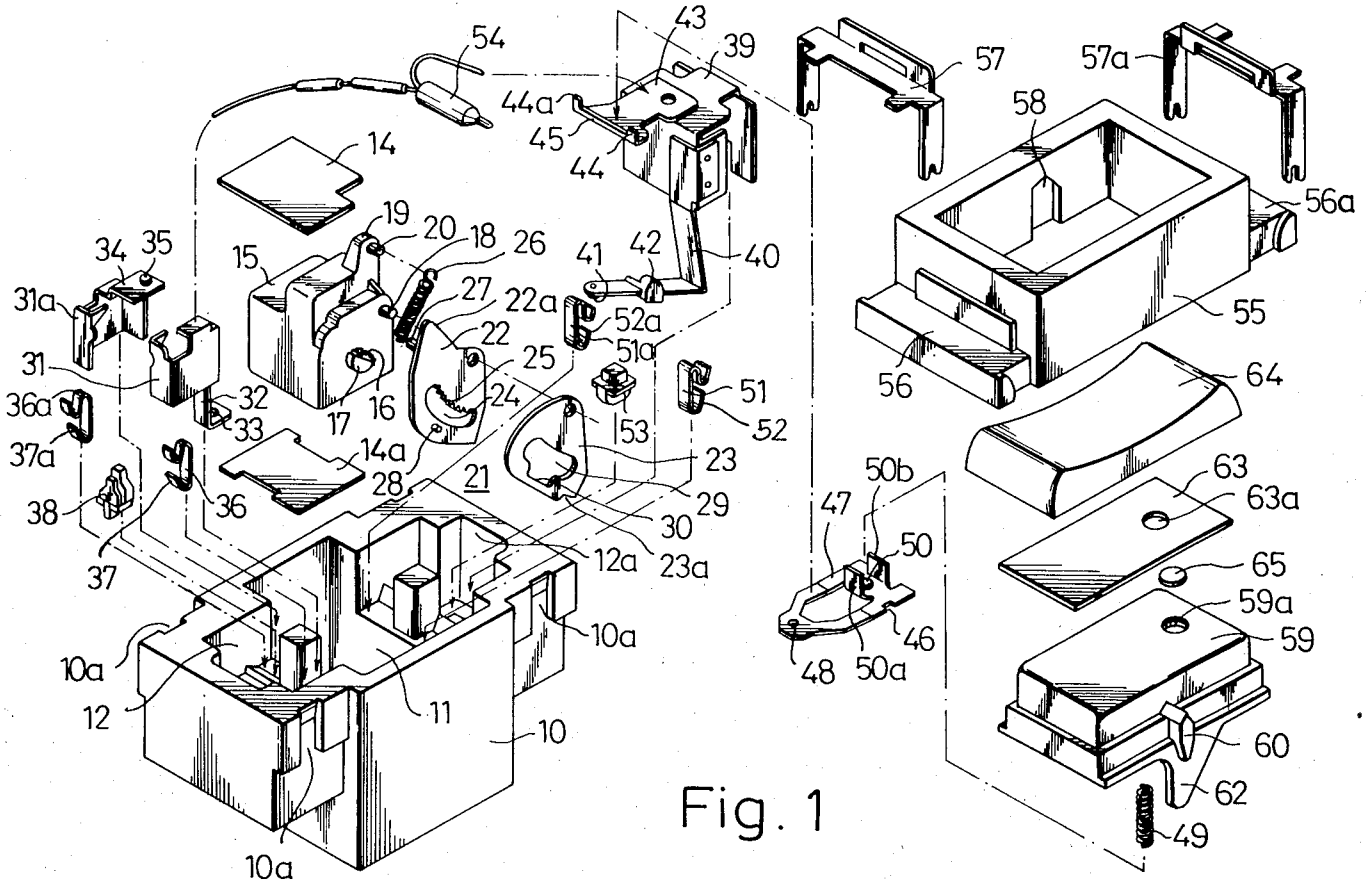
FIG. 1 is a perspective view as disassembled of the delay switch in an embodiment according to the present invention.
Figure 2:
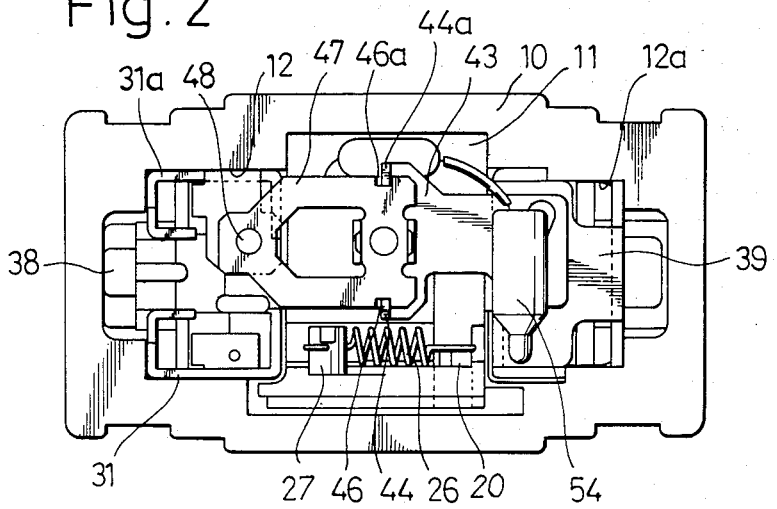
FIG. 2 is a top plan view of the switch of FIG. 1 with the cover member and contact actuating means removed.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Referring to FIGS. 1 to 4, there is shown a delay switch in an embodiment according to the present invention, which comprises a body 10 having a housing chamber 11 in the center and connecting chambers 12 and **12*a* provided adjacent to the housing chamber 11 on its both sides in the longitudinal direction. Those connecting chambers 12 and 12*a* are provided in their bottom walls with holes 13 and 13*a* for insertion of connection wires (not shown). Seated within the central housing chamber 11 of the body 10 is a delay element 15 with a pair of insulating plates 14 and 14*a* positioned at the top and bottom of the delay element 15. An output pinion 16 partly enclosed in a cover 17 is projected out of one side of the element. The delay element is conventional and includes a combination of a gear train and a delay plate to generate a delayed output, an arrangement in which an electrically conductive plate is provided between opposing opposite poles of magnets for generating an eddy current in the conductive plate, or the like arrangement. The delay element 15 is also provided on the same side as the pinion 16 with an outwardly projecting pivot pin 18, and on the top with an upward extended portion 19 having an engaging pin 20 projecting also on the same side, i.e., parallel to the pin 18**.

Further on the particular side of the delay element 15 where the pinion 16 and pin 18 are provided, the element has a delay cam unit 21 which includes first and second delay cams 22 and 23 commonly pivotably mounted on the pivot pin 18. The first delay cam 22 is nearist the element and is formed to have an arcuate opening 24 through which the output pinion 16 and cover 17 of the delay element 15 extend. The opening 24 has at its upper edge a rack portion 25 meshing with the output pinion 16. The first delay cam 22 is also formed to have an engaging pin 27 projected on the side facing the delay element 15 and positioned above one end of the opening 24. A tension spring 26 is hung between the pin 20 of the upward extended portion 19 and the pin 27 of the cam 22. Further, an interlocking pin 28 is provided to project on the other side facing the second cam 23, at a lower position beneath the opening 24. The second delay cam 23 is provided, on the other hand, with a substantially arcuate opening 29 which is larger than the opening 24 of the first cam 22 and positioned to align with the opening 24. The opening 29 of the second cam 23 has a downwardly expanded part 30 in which the interlocking pin 28 of the first cam 22 is movably fitted to define a lost motion connection between said cams 22, 23. When the pin 28 is in either one of positions abutting two side ends 30*a* and 30*b* of the expanded part 30, the second delay cam 23 can be interlocked to the first delay cam 22 to swing integrally therewith about the pin 18.

Seated within one connecting chamber 12 of the body 10 are a pair of fixed-contact side terminal plates 31 and 31*a* which are positioned on the wire insert hole 13 and mutually opposed in a direction intersecting the longitudinal direction of the body 10, and the terminal plates 31 and 31*a* are substantially U-shaped as viewed from the top. The terminal plate 31 is provided with an arm 32 which extends downwardly in an L shape to be positioned below the second delay cam 23 at a horizontally extended end where a first fixed contact 33 is secured, while the other terminal plate 31*a* is provided on the top with a lug 34 which extends toward the terminal 31, and a second fixed contact 35 is secured onto this lug 34. Inside each of these U-shaped terminal plates 31 and 31*a*, there is provided a substantially S-shaped locking spring 36 or 36*a* elongated at one end and having at least at a lower end thereof a resilient wedge portion 37 and 37*a* respectively allowing the connecting wires to be inserted through the insert hole 13 into contact with the terminals but preventing them from being pulled off by pressing the wires against the body 10. Across the both locking springs 36 and 36*a*, a release button 38 is disposed to be urged between the wedge portions 37 and 37*a* and opposing side wall of the chamber 12 against their resilient force by means of a tool inserted through the insert hole 13 to deflect the wedge portions away from the wires for eliminating the wedging action of the wedge portions 37 and 37*a* and allowing the wires to be easily disconnected and pulled out of the insert hole 13. It will be appreciated that, while the insert hole 13 is shown as being single in the illustrated embodiment, the hole may preferably comprise a pair of relatively larger holes respectively positioned below the locking springs 36 and 36*a* for the connecting wire insertion, and a relatively smaller hole positioned between these larger holes to be immediately below the release button 38 for the jig insertion.

Within the other connecting chamber 12*a* of the body 10, there is provided a movable-contact side terminal plate 39 substantially U-shaped in a side elevation, which carries a substantially L-shaped, resilient movable contactor 40 secured at the upper end part of its vertical leg to a corner part of one leg of the U-shaped terminal plate 39 on the side of the central housing chamber 11. The movable contactor 40 has a first movable contact 41 at the other lower end of the horizontal leg extended below the second delay cam 23, and this first movable contact 41 is disposed above the first fixed contact 33 of the first terminal plate 31 so as to be resiliently contactable therewith. Substantially at the middle position of the horizontal leg of the movable contactor 40, an interlocking member 42 of an insulating material is provided to be engageable with the lowermost portion of the second delay cam 23. In the illustrated embodiment, the second delay cam 23 is provided preferably at its lowermost portion with a notch 23*a* and the interlocking member 42 is positioned to be within this notch 23*a* when the cam 23 is in its non-actuated position. Further, on the top surface of the movable-contact side terminal plate 39, there is secured a lead plate 43 which is inwardly extended to be above the delay element 15. At such inwardly extended end the plate 43 includes a small supporting part 45 having small upward projected lugs 44 and 44*a* at both side corners in the direction intersecting the longitudinal direction of the body 10. A rocking member 47 is rockably mounted on the supporting part 45 of the lead plate 43 with the lugs 44 and 44*a* fitted into small notches 46 and 46*a* provided in the rocking member 47. A second movable contact 48 secured to a free end of the member 47 is arranged to be contactable with the second fixed contact 35 on the second fixed-contact side terminal plate 31*a*. The rocking member 47 also has a spring holding part which comprises a small projection 50 and a pair of parallel upward projected arms 50*a* and 50*b* for holding a lower end of a compression spring 49. Within the U-shaped movable-contact side terminal plate 39, further, there is provided a pair of locking springs 51 and 51*a* substantially S-shaped to form wedge portions 52 and 52*a*. The springs 51, 51*a* are spaced from each other in the direction intersecting the body's longitudinal direction. The plate 39 is also provided with a release button 53 disposed across the springs 51 and 51*a*. In the present instance, the arrangement and operation of the locking springs 51 and 51*a* having the wedge portions 52 and 52*a*, release button 53 and insert hole 13*a* are substantially the same as those of the locking springs 36 and 36*a*, release button 38 and insert hole 13 in the connecting chamber 12. On the lead plate 43, further, a neon lamp 54 electrically connected at one end to the lead plate 43 and at the other end to the first fixed-contact side terminal plate 31 is provided.

A cover member 55 of a rectangular frame shape is mounted on the top of the body 10 and has skirt parts 56 and 56*a* extended in the longitudinal direction from both end surfaces. U-shaped clamps 57 and 57*a* are mounted on the skirt parts 56 and 56*a* with their intermediate portions seated on the skirt parts and their leg portions inserted into vertical recesses 10*a* provided in side walls of the body 10. After the clamps 57, 57*a* have been inserted into the recesses 10*a*, forked ends of the leg portions of the clamps 57 and 57*a* are deformed mutually in opposite directions so that the legs 57, 57*a* cannot be removed from the recesses, whereby the cover member 55 is fixedly mounted onto the body 10. The cover member 55 is provided with inner side walls having a pair of opposing recesses 58 (only one is seen in FIG. 1) which are opened downward, and a handle body 59 having on both sides a pair of pivot projections 60 (only one is seen also in FIG. 1). The handle body 59 is housed in the cover member 55 with the pivot projections 60 engaged pivotably in the recesses 58 of the cover member 55 so that the handle body 59 can rock about the projections 60. Inside the handle body 59, there is provided a holding recess 61 opened downward for holding an upper end of the compression spring 49 while the other end of this spring 49 is held by the spring holding part 50 on the rocking member 47. The handle body 59 further has at one lower side edge a cam actuating arm 62 extending downward to be engageable with a cam surface 22*a* of the first delay cam 22. A transparent, shallow box-shaped cover 64 is mounted on the top surface of the handle body 59 preferably through a card 63. The handle body 59 and card 63 are provided with aligning holes 59*a* and 63*a* respectively at positions allowing visual observation of the neon lamp 54 on the lead plate 43, and such a transparent lid 65 as, preferably, a lens is attached to the hole 59*a* of the handle body 59.

The operation of the delay switch according to the present invention shall now be detailed. When the handle body 59 is pushed to rock clockwise from a state of FIG. 3 to that of FIG. 5, the compression spring 49 held between the recess 61 in the handle body 59 and the spring holding part 50 of the rocking member 47 is reversed in its dogleg bent shape so that the spring 49 resiliently pushes against the arm 50*a* of the spring holding part 50 to urge the member 47 to rock counterclockwise until the second movable contact 48 on the member 47 comes into contact with the second fixed contact 35 on the terminal plate 31*a*. Thus, an electric path is formed from the movable-contact side terminal plate 39 through the lead plate 43, rocking member 47, second movable contact 48 and second fixed contact 35 to the second fixed-contact side terminal plate 31*a*.

Simultaneously with the foregoing clockwise rocking of the handle body 59, the actuating arm 62 of the handle body 59 is also rotated to cause the cam surface 22*a* of the first delay cam 22 to be pushed in opposition to the tension of the spring 26 whereby this cam 22 rotates counterclockwise about the pivot pin 18 on the delay element 15 from a final position to a start position. As the first delay cam 22 rotates thus, the interlocking pin 28 of the first delay cam 22 slides along the expanded part 30 of the opening 29 in the second delay cam 23 to abut the other end 30*b* in the expanded part 30. Thus, the second delay cam 23 is rotated counterclockwise together with the first delay cam 22, causing the interlocking member 42 of the movable contactor 40, now positioned in the notch 23*a* of the second delay cam 23, to ride on the lower edge of the cam 23. Consequently, the first movable contact 41 of the movable contactor 40 engages the first fixed contact 33 of the first terminal plate 31*a*, whereby a further electric path is formed from the terminal plate 39 through the movable contactor 40, movable contact 41 and fixed contact 33 to the first fixed-contact side terminal plate 31.

Therefore, when the delay switch of the present invention is used, for example, as a switch for an illuminair and ventilating fan installed in a toilet room in such that the movable-contact side of terminal plate 39 is connected to a power source, and the first and second fixed terminal plates 31 and 31*a* are connected to terminals of a driving circuit for the ventilating fan and a lighting circuit for the illuminair, respectively, such actuation of the delay switch as described above to turn it to the position of FIG. 5 will cause the illuminair to be lit and the ventilating fan to be rotated for illuminating and ventilating the toilet room.

Figure 3:
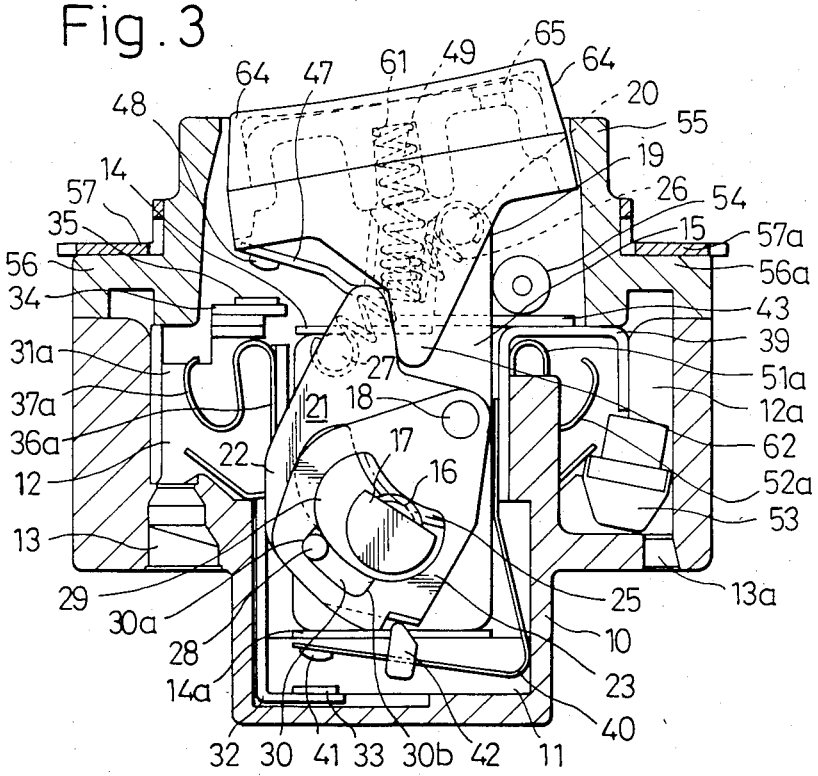
FIG. 3 is a vertically sectioned view of the switch of FIG. 1 in contact opening state.
Figure 5:
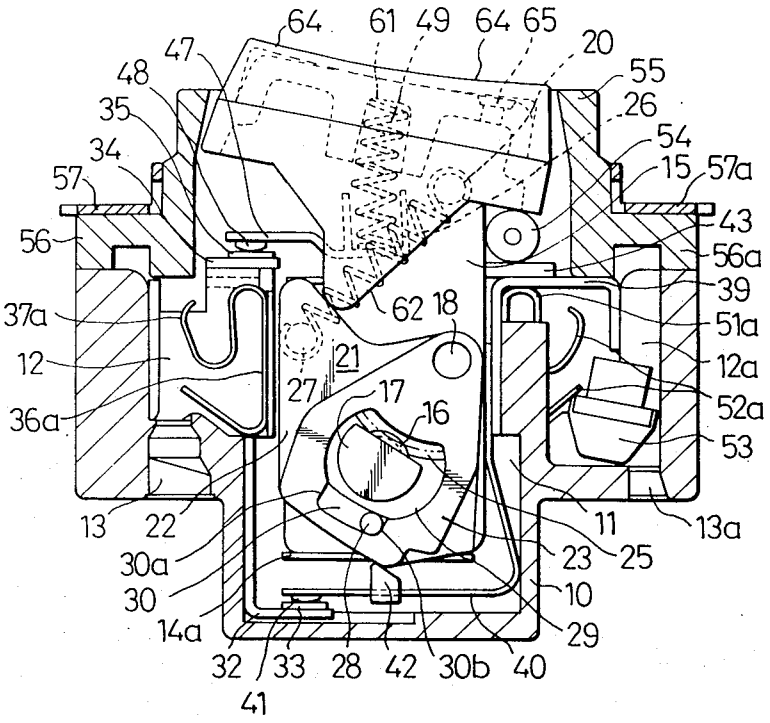
FIG. 5 is a vertically sectioned view similar to FIG. 3 but in contact closing state of the switch of FIG. 1.
Figure 4:
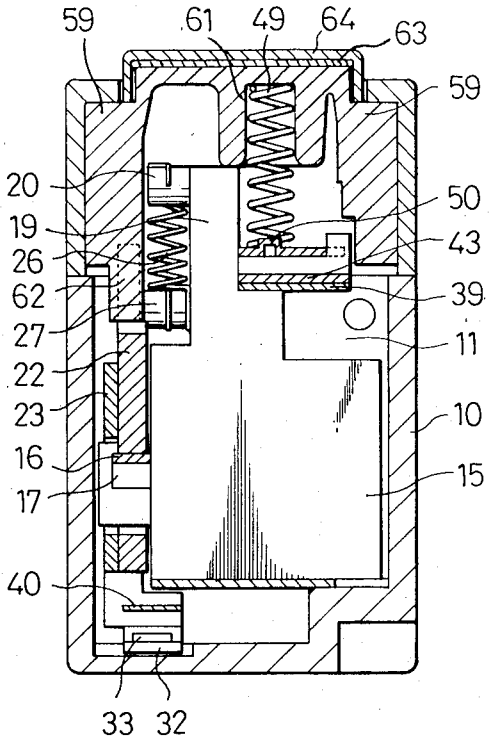
FIG. 4 is a cross sectional view of the switch of FIG. 1 taken on a vertical plane along right-hand side of the delay element in FIG. 3.

When the handle body 59 is rotated counterclockwise from the state of FIG. 5 to that of FIG. 3, on the other hand, the compression spring 49 is reversed in the dogleg shape to bend so that the lower part of the spring 49 will push the other arm 50*b* of the spring holding part 50, causing the rocking member 47 to be rotated clockwise to separate the second movable contact 48 from the second fixed contact 35 of the second terminal plate 31*a* so that, if the lighting circuit is connected to the second terminal plate 31*a*, the illuminair will be immediately turned OFF.

Simultaneously with such counterclockwise rotation of the handle body 59, the pushing force of the actuating arm 62 to the first delay cam 22 is released. In the present instance, the delay element 15 is provided to start its operation upon the counterclockwise rotation of the handle body 59, that is, the turning OFF operation of the delay switch, and the tension spring 26 is provided to bias the first delay cam 22 to the position of FIG. 3. When the output pinion 16 of the delay element 15 starts to rotate slowly, the first delay cam 22 starts to rotate clockwise, but the second delay cam 23 still does not start to rotate until the interlocking pin 28 of the first delay cam 22 is shifted from the end 30*b* of the expanded opening part 30 of the second delay cam 23 and reaches the other end 30*a* of the expanded part 30. When the end 30*a* is reached by the pin 28, the second delay cam 23 is thereby urged to be rotated and the interlocking member 42 of the movable contactor 40 resiliently falls into engagement in the notch 23*a* of the second delay cam 23. The movable contactor 40 returns, due its own resiliency, to the original position to separate the first movable contact 41 from the first fixed contact 33, with a delayed time determined by the delay output of the delay element 15. When the driving circuit for the ventilating fan is connected, for example, to the first fixed terminal plate 31, therefore, the illuminair is immediately turned OFF upon the user's turning OFF of the switch, but the ventilating fan is turned OFF after the predetermined delayed time, during which the ventilating fan continues to ventilate the toilet room.

In the foregoing delay switch, the movable contactor 40 shifts upward to have the first movable contact 41 instantaneously separated from the first fixed contact 33 as soon as the interlocking member 42 engages in the notch 23*a* of the delay cam 23, and this instantaneous separation is effective to reduce any arc which tends to occur upon the contact separation. Further, because the insulating plates 14 and 14*a* are provided at the top and bottom of the delay element 15, any influence of heat generated due to the arc at the first and second contact members on the delay element 15 can be restrained. Further, since the neon lamp 54 disposed on the lead plate 43 is electrically connected between the lead plate 43 integral with the movable-contact side terminal plate 39 and the first fixed-contact side terminal plate 31 to be lit always, the lamp 54 always projects its light through the holes 59*a* and 63*a* of the handle body 59 and card 63 and through the transparent card cover 64, so that the user can easily recognize the position of the switch even at night.

More particularly, the delay switch according to the present invention assures that, even when the handle body 59 is operated to turn ON the switch soon after it has been turned OFF and while the interlocking pin 28 of the first delay cam 22 is still moving along the expanded part 30 of the second delay cam 23 toward the position of FIG. 3, the delay action of the element 15 is always started from a constant position of the interlocking pin 28 of the first delay 22. This occurs because the turning ON operation of the handle body 59 returns the first delay cam 22 as well as the pin 28 to the position of FIG. 5 where the pin 28 abuts the end 30*b* of the expanded part 30 with the second delay cam 23 still in the FIG. 5 position, so that the continuous ventilation for the full delayed time after the next OFF operation of the switch can be made.

Further, the extreme position of the handle body 59 either in the counterwise or counterclockwise direction and eventually the delay action of the element 15 can be stabilized so long as no external force is applied, because in such extreme position of FIG. 3 or 5 the dogleg shape bent state of the compression spring 49 between the handle body 59 and the rocking member 47 causes these two members to be rotated in opposition directions with the largest acting resilient force of the spring 49 tending to restore the spring to its straightened posture.

The delay switch of the present invention may be modified in various ways. For example, the arrangement of the switch has been described with reference to the delay action achieved upon the OFF operation of the switch, but the action is made achievable contrarily upon the ON operation by reversing the positions of the fixed contacts 33 and 35 to be rather positioned above the movable contacts 41 and 48, in the same arrangement of all other members of the switch as has been described.

What is claimed as our invention is:

1. A delay switch comprising a body, a cover member integrally mounted onto said body and having a top opening, a delay element disposed substantially in the center of the body and providing an output drive, a delay cam unit provided on one side of said delay element and operatively linked to said output drive for performing a delay operation in response to being driven by said output drive, switching contact members including a movable contactor linked to said delay cam unit to be actuated after a predetermined delay time, terminal plate members provided on opposing sides of the delay element and electrically connected to said contact members and to connecting wires inserted through connecting holes of the body, and contact actuating means positioned above the delay element within said cover member and including a rockable actuating handle disposed in said opening of the cover member for actuating the contact members and delay cam unit.

2. A delay switch according to claim 1, wherein said delay cam unit starts rotating constantly from a start position upon actuation by said handle.

3. A delay switch according to claim 2, wherein said delay element includes a pinion for transmitting said output drive and a pivot pin at a position spaced from said pinion, said pinion and pivot pin projecting from said element on the same side thereof, said delay cam unit includes first and second delay cams commonly pivoted to said pivot pin of the delay element, said first delay cam having a rack part meshing with the pinion of the delay element and an interlocking pin engageable with said second delay cam, said second delay cam being provided with an opening in which said interlocking pin of the first delay cam is engaged for interlocking the second delay cam with the first delay cam at a predetermined point of rotation of the first delay cam.

4. A delay switch according to claim 3, wherein said body includes a central housing chamber and connecting chambers provided adjacent both ends of said central chamber in the longitudinal direction of the body and respectively having a through hole for inserting each of said connecting wires, said central chamber receiving said delay element, and said connecting chambers respectively receiving each of fixed and movable contact side terminal plates electrically connected respectively to each of the connecting wires, said fixed contact side terminal plate having a fixed contact, and said movable contactor is coupled to said movable contact side terminal plate and carries a first movable contact.

5. A delay switch according to claim 4, wherein said fixed contact side terminal plate provided in one of said connecting chambers on one longitudinal side of said central chamber comprises first and second fixed terminal plates, said movable contact side terminal plate includes a second movable contact on a rockable member linked to the plate, said first fixed terminal plate having a first fixed contact contactable with said first movable contact of said movable contactor, said second fixed terminal plate having a second fixed contact contactable with said second movable contact of said rockable member, and said contact actuating means is provided for actuating said rockable member simultaneously with said delay cam unit.

6. A delay switch according to claim 4, wherein said movable contactor is provided with an interlock member, and said second delay cam is provided with a notch into which said interlock member is engageable in non-actuated state with respect to the movable contactor.

7. A delay switch according to claim 5, including a lamp connected between said movable contact side terminal plate and said first fixed terminal plate to be lit always, and said contact actuating means is permeable to light.

8. A delay switch comprising a body; a delay element disposed within said body and including a rotary output shaft; delay cam means arranged to be driven from a start position to a final position by said delay element, said delay cam means including a first pivotably mounted cam operably connected to said output shaft to be rotated thereby, and a second pivotably mounted cam operably connected to said first cam to be driven by a lost motion connection therebetween whereby said second cam remains stationary during a predetermined amount of rotation of said first cam and is thereafter rotated to said final position by said first cam; electrical contact means for connection to an external electrical component to be operated, said contact means arranged to be actuated by said second cam when said delay cam means is in said start position to operate said external component and deactuated when said delay cam means is in said final position; and a manual handle movable to a first position for setting said delay cam means in said start position and movable to a second position for actuating said delay element.

* * * * *